United States Patent [19]

Kawano et al.

[11] Patent Number: 5,030,298

[45] Date of Patent: Jul. 9, 1991

[54] PROCESS FOR PRODUCING A HOT ROLLED STEEL SHEET WITH HIGH STRENGTH AND DISTINGUISHED FORMABILITY

[75] Inventors: Osamu Kawano, Oita; Manabu Takahashi, Tokyo; Junichi Wakita; Kazuyoshi Esaka, both of Oita, all of Japan

[73] Assignee: Nippon Steel Corporation, Tokyo, Japan

[21] Appl. No.: 573,056

[22] Filed: Aug. 23, 1990

Related U.S. Application Data

[60] Division of Ser. No. 442,445, Nov. 27, 1989, which is a continuation-in-part of Ser. No. 201,408, Jun. 2, 1988, abandoned.

[30] Foreign Application Priority Data

Jun. 3, 1987 [JP] Japan ..... 62-138060
Feb. 29, 1988 [JP] Japan ..... 63-44527

[51] Int. Cl.[5] ..... C21D 8/02
[52] U.S. Cl. ..... 148/12 F; 148/12 C
[58] Field of Search ..... 148/12.4, 12 F, 12 C

[56] References Cited

U.S. PATENT DOCUMENTS 4,184,898 1/1980 Ouchi et al. ..... 148/12 F
4,285,741 8/1981 Furukawa et al. ..... 148/12 F
4,397,698 8/1983 Davenport et al. ..... 148/12 F
4,501,626 2/1985 Sudo et al. ..... 148/12 F

FOREIGN PATENT DOCUMENTS 60-43425 3/1985 Japan .
60-165320 8/1985 Japan .
60-181230 9/1985 Japan .
60-184664 9/1985 Japan .
61-136633 6/1986 Japan ..... 148/12 F
63-4017 1/1988 Japan .

*Primary Examiner*—Deborah Yee
*Attorney, Agent, or Firm*—Wenderoth, Lind & Ponack

[57] ABSTRACT

A hot rolled steel sheet with a high strength and a distinguished formability, and a process for producing the same are disclosed. The steel sheet comprises 0.15 to 0.4% by weight of C, 0.5 to 2.0% by weight of Si, and 0.5 to 2.0% by weight of Mn, the balance being iron and inevitable impurities, and has a microstructure composed of ferrite, bainite and retained austenite phases with the ferrite phase being a ratio ($V_{PF}/d_{PF}$) of polygonal ferrite volume fraction $V_{PF}$(%) to polygonal ferrite average grain size $d_{PF}$ (μm) of 7 or more and the retained austenite phase being contained in an amount of 5% by volume or more on the basis of the total phases. The steel sheet can be produced with a high productivity and without requiring special alloy elements.

21 Claims, 6 Drawing Sheets

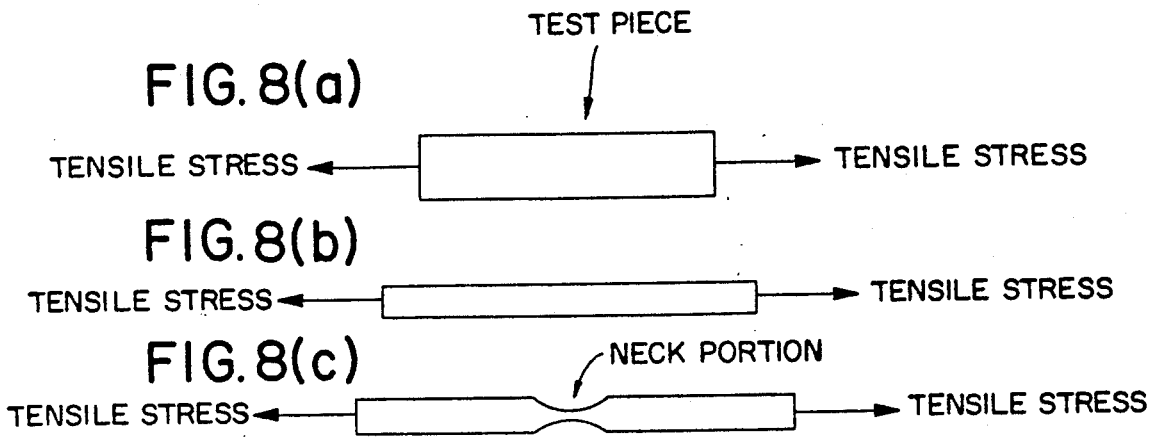
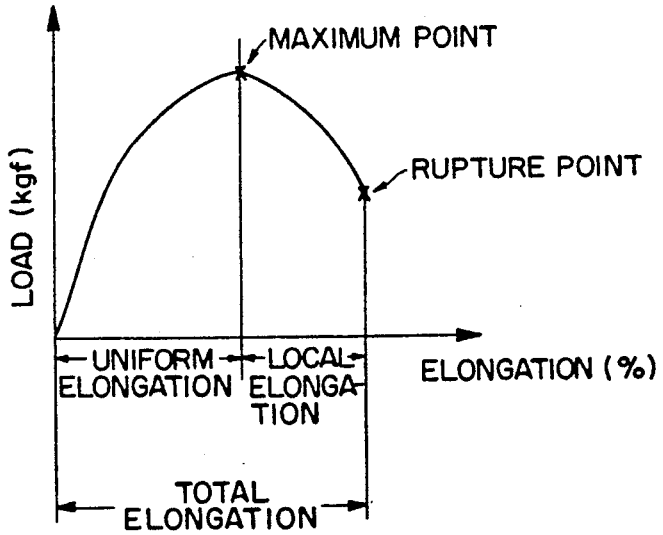
FIG. 9

PROCESS FOR PRODUCING A HOT ROLLED STEEL SHEET WITH HIGH STRENGTH AND DISTINGUISHED FORMABILITY

CROSS-REFERENCE TO RELATED APPLICATION

This application is a division of Ser. No. 07/442,445 filed Nov. 27, 1989, now issued which is a continuation-in-part of Ser. No. 07/201,408 filed June 2, 1988, now abandoned.

BACKGROUND OF THE INVENTION

1. Technical Field

This invention relates to a hot rolled steel sheet with a high ductivility, a high strength and a distinguished formability applicable to automobiles, industrial machinery, etc., and a process for producing the same. The term "sheet" means "sheet" or "plate" in the present specification and claims.

2. Description of the Prior Art

In order to make the automobile steel sheet lighter and ensure safety at collisions, steel sheets with a higher strength have been in keen demand. Steel sheets even with a high strength have been required to have a good formability. That is, a steel sheet must have a high strength and a good formability at the same time.

A dual phase steel composed of a ferrite phase and a martensite phase, which will be hereinafter referred to as "DP steel", has been so far proposed as a hot rolled steel sheet applicable to the fields requiring a high ductility. It is known that the DP steel has a more distinguished strength-ductility balance than a solid solution-intensified steel sheet with a high strength and a precipitation-intensified steel sheet with a high strength. However, there is such a limit to the strength-ductility balance as $TS \times T.El \leqq 2{,}000$, where TS represents a tensile strength ($kgf/mm^2$) and T.El represents a total elongation (%), and thus the DP steel cannot meet more strict requirements.

In order to overcome the limit to the strength-ductility balance, that is, to obtain $TS \times T.El > 2{,}000$, it has been proposed to utilize a retained austenite phase. For example, the following processes have been proposed: a process for producing a steel sheet having a retained austenite phase, which comprises hot rolling a steel sheet at a finish temperature of $Ar_3$ to $Ar_3 + 50°$ C., then maintaining the steel sheet at a temperature of 450° C. to 650° C. for 4 to 20 seconds, and then coiling the steel sheet at a temperature of not more than 350° C. [Japanese Patent Application Kokai (Laid-open) No. 60-43425], a process for producing a steel sheet having a retained austenite phase, which comprising rolling a steel sheet at a finish temperature of 850° C. or more with a total draft of 80% or more and under a high reduction with a draft of 60% or more for the last total three passes and a draft of 20% r more for the last pass, and successively cooling the steel sheet down to 300° C. or less at a cooling rate of 50° C./sec. or more [Japanese Patent Application Kokai (Laid-open) No. 60-165,320], etc.

However, the conventional processes requiring the maintenance of a steel sheet at 450° to 650° C. for 4 to 20 seconds during the cooling, the coiling at a low temperature such as not more than 350° C., or the rolling under a high reduction are not operationally preferable with respect to the energy saving and productivity increase. The formability of the steel sheets obtained according to these processes is, for example, $TS \times T.El \leqq 2{,}416$ and thus does not always fully satisfy the level required by users. A steel sheet with a higher $TS \times T.El$ value (desirably more than 2,416) and a process for producing the same with a higher productivity have been in keen demand.

SUMMARY OF THE INVENTION

As a result of extensive tests and researches (in which later-explained Transformation Induced Plasticity phenomenon is utilized, i.e. unstable, high retained austenite is utilized) for obtaining a steel sheet with $TS \times T.El \geqq 2{,}000$, which is over the limit of the prior art, the present inventors have found that at least 5% by volume of an austenite phase must be contained, as shown in FIG. 1, directed to steel species A in an Example that follows, and have confirmed that the $TS \times T.El$ value can be assuredly made to exceed the level of the aforementioned DP steel, i.e. $TS \times T.El \approx 2{,}000$, thereby. Further, the present inventors have found that the increase in $TS \times T.El$ based on an increase in an amount of retained austenite is greatly based on an increase in uniform elongation, and that if a hot rolled steel sheet contains a retained austenite in an amount of 5% or more, a uniform elongation amount of 20% or more, which is necessary for a hot rolled steel sheet with a high strength and a distinguished formability, can be secured, and further a total elongation amount of 30% or more, which is more preferable, can also be secured in most cases.

The present invention is based on this finding and an object of the present invention is to provide a hot rolled steel sheet with a high strength and a distinguished formability, which contains 5% by volume or more of a retained austenite phase, and also a process for stably, assuredly and economically producing such a steel sheet as above.

The foregoing object of the present invention can be attained by the following means:

(1) A hot rolled steel sheet with a high strength and a distinguished formability, consisting essentially of 0.15 to 0.4% by weight of C, 0.5 to 2.0% by weight of Si, 0.5 to 2.0% by weight of Mn and 0.0005 to 0.0100% by weight of Ca, with S being limited to not more than 0.010% by weight and the balance being iron and inevitable impurities, and having a microstructure composed of ferrite, bainite and retained austenite phase with the ferrite phase being in a ratio ($V_{PF}/d_{PF}$) of polygonal ferrite volume fraction $V_{PF}$ (%) to the polygonal ferrite average grain size $d_{PF}$ (μm) of 7 or more and the retained austenite phase being contained in an amount of 5% by volume or more on the basis of the total phases.

(2) A hot rolled steel sheet as described in (1), wherein said steel sheet further contains 0.004 to 0.040% by weight of Al.

(3) A hot rolled steel sheet with a high strength and a distinguished formability, consisting of 0.15 to 0.4% by weight of C, 0.5 to 2.0% by weight of Si, 0.5 to 2.0% by weight of Mn, 0.004 to 0.040% by weight of Al and 0.0005 to 0.0100% by weight of Ca, with S being limited to not more than 0.010% by weight and the balance being iron and inevitable impurities, and having a microstructure composed of ferrite, bainite and retained austenite phase with the ferrite phase being in a ratio ($V_{PF}/d_{PF}$) of polygonal ferrite volume fraction $V_{PF}$ (%) to the polygonal ferrite average grain size $d_{PF}$ (μm) of 7 or more and the retained austenite phase being contained in an amount of 5% by volume or more on the basis of the total phases.

(4) A hot rolled steel sheet with a high strength and a distinguished formability, consisting essentially of 0.15 to 0.4% by weight of C, 0.5 to 2.0% by weight of Si, 0.5 to 2.0% by weight of Mn and 0.0005 to 0.0100% by weight of Ca, with S being limited to not more than 0.010% by weight and the balance being iron and inevitable impurities, and having a microstructure composed of ferrite, bainite and retained austenite phase with the ferrite phase being in a ratio ($V_{PF}/d_{PF}$) of polygonal ferrite volume fraction $V_{PF}$ (%) to the polygonal ferrite average grain size $d_{PF}$ (μm) of 7 or more and the retained austenite phase being contained in an amount of 5% by volume or more on the basis of the total phases, wherein said steel sheet has a uniform elongation of 20% or more.

(5) A hot rolled steel sheet as described in (4), wherein said steel sheet further contains 0.004 to 0.040% by weight of Al.

(6) A hot rolled steel sheet with a high strength and a distinguished formability, consisting essentially of 0.15 to 0.4% by weight of C, 0.5 to 2.0% by weight of Si, 0.5 to 2.0% by weight of Mn and 0.0005 to 0.0100% by weight of Ca, with S being limited to not more than 0.010% by weight and the balance being iron and inevitable impurities, and having a microstructure composed of ferrite, bainite and retained austenite phase with the ferrite phase being in a ratio ($V_{PF}/d_{PF}$) of polygonal ferrite volume fraction $V_{PF}$ (%) to the polygonal ferrite average grain size $d_{PF}$ (μm) of 7 or more and the retained austenite phase being contained in an amount of 5% by volume or more on the basis of the total phases, wherein said steel sheet has a uniform elongation of 20% or more and a total elongation of 30% or more.

(7) A hot rolled steel sheet as described in (6), wherein said steel sheet further contains 0.0004 to 0.040% by weight of Al.

(8) A process for producing a hot rolled steel sheet with a high strength and a distinguished formability, which comprises subjecting a steel consisting/essentially of 0.15 to 0.4% by weight of C, 0.5 to 2.0% by weight of Si, and 0.5 to 2.0% by weight of Mn, the balance being iron and inevitable impurities, to a hot finish rolling with a total draft of at least 80% in such a manner that its rolling end temperature is within a range between $Ar_3+50°$ C. and $Ar_3-50°$ C., successively cooling the steel down to a desired temperature T within a temperature range from the lower one of the $Ar_3$ of said steel or said rolling end temperature to $Ar_1$ at a cooling rate of less than 40° C./sec., successively cooling the steel at a cooling rate of 40° C./sec. or more, and coiling the steel at a temperature of from over 350° C. to 500° C.

(9) A process as described in (8), wherein cooling is conducted for 3 to 25 seconds to cool said steel within a temperature range from the lower one of the $Ar_3$ of said steel or said rolling end temperature to said desired temperature T or to hold said steel isothermally within said temperature range.

(10) A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal, with S being limited to not more than 0.010% by weight and the balance being iron and inevitable impurities, to a hot finish rolling with a total draft of at least 80% in such a manner that its rolling end temperature is within a range between $Ar_3+50°$ C. and $Ar_3-50°$ C., successively cooling the steel down to a desired temperature T within a range from the lower one of the $Ar_3$ of said steel or said rolling end temperature to $Ar_1$ at a cooling rate of less than 40° C./sec., successively cooling the steel at a cooling rate of 40° C./sec. or more, and coiling the steel at a temperature of from over 350° C. to 500° C.

The term "rare earth metal" or "REM" hereinafter means at least one of the fifteen metallic metals (elements) (La, Ce, Pr, Nd, Pm, Sm, Eu, Gd, Tb, Dy, Ho, Er, Tm, Yb and Lu) following lanthanum through lutetium with atomic numbers 57 through 71. The rare earth metal (REM) is added frequently in the form of a mischmetal which is an alloy of REM and that has a composition comprising 50% of lanthanum, neodymium and the other metal in the same series and 50% of cerium.

(11) A process as described in (10), wherein cooling is conducted for 3 to 25 seconds to cool said steel within a temperature range from the lower one of the $Ar_3$ of said steel or said rolling end temperature to said desired temperature T or to hold said steel isothermally within said temperature range.

(12) A process for producing a hot rolled steel sheet with a high strength and a distinguished formability, which comprises subjecting a steel consisting essentially of 0.15 to 0.4% by weight of C, 0.5 to 2.0% by weight of Si and 0.5 to 2.0% by weight of Mn, the balance being iron and inevitable impurities, to a hot finish rolling with a total draft of at least 80% in such a manner that its rolling end temperature is within a range between $Ar_3+50°$ C. and $Ar_3-50°$ C., setting two desired temperatures $T_1$ and $T_2$, wherein $T_1 \geqq T_2$ within a temperature range from the lower one of the $Ar_3$ of said steel or said rolling end temperature to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

(13) A process as described in (12), wherein cooling is conducted for 3 to 25 seconds to cool said steel within a temperature range from said desired temperature $T_1$ to said desired temperature $T_2$ or to hold said steel isothermally within said temperature range.

(14) A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal, with S being limited to not more than 0.010% by weight and the balance being iron and inevitable impurities, to a hot finish rolling with a total draft of at least 80% in such a manner that its rolling end temperature is within a range between $Ar_3+50°$ C. and $Ar_3-50°$ C., setting two desired temperatures $T_1$ and $T_2$, wherein $T_1 \geqq T_2$ within a temperature range from the lower one of the $Ar_3$ of said steel or said rolling end temperature to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

(15) A process as described in (14), wherein cooling is conducted for 3 to 25 seconds to cool said steel within a temperature range from said desired temperature $T_1$ to said desired temperature $T_2$ or to hold said steel isothermally within said temperature range.

(16) A process for producing a hot rolled steel sheet with a high strength and a distinguished formability, which comprises subjecting a steel consisting essentially of 0.15 to 0.4% by weight of C, 0.5 to 2.0% by weight of Si, and 0.5 to 2.0% by weight of Mn, the balance being iron and inevitable impurities, to a hot finish rolling with a total draft of at least 80% in such a manner that its rolling end temperature exceeds $Ar_3+50°$ C., successively cooling the steel down to a desired temperature T within a temperature range from the $Ar_3$ of the steel to $Ar_1$ at a cooling rate of less than 40° C./sec., successively cooling the steel at a cooling rate of 40° C./sec. or more, and coiling the steel at a temperature of from over 350° C. to 500° C.

(17) A process as described in (16), wherein cooling is conducted for 3 to 25 seconds to cool said steel within a temperature range from the $Ar_3$ of said steel to said desired temperature T or to hold said steel isothermally within said temperature range.

(18) A process for producing a hot rolled steel sheet with a high strength and a distinguished formability, which comprises subjecting a steel consisting-essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal, with S being limited to not more than 0.010% by weight and the balance being iron and inevitable impurities, to a hot finish rolling with a total draft of at least 80% in such a manner that its rolling end temperature exceeds $Ar_3+50°$ C.

successively cooling the steel down to a desired temperature T within a range from the $Ar_3$ of the steel to $Ar_1$ at a cooling rate of less than 40° C./sec., successively cooling the steel at a cooling rate of 40° C./sec. or more, and coiling the steel at a temperature of from over 350° C. to 500° C.

(19) A process as described in (18), wherein cooling is conducted for 3 to 25 seconds to cool said steel within a temperature range from the $Ar_3$ of said steel to said desired temperature T or to hold said steel isothermally within said temperature range.

(20) A process for producing a hot rolled steel sheet with a high strength and a distinguished formability, which comprises subjecting a steel consisting essentially of 0.15 to 0.4% by weight of C, 0.5 to 2.0% by weight of Si and 0.5 to 2.0% by weight of Mn, the balance being iron and inevitable impurities, to a hot finish rolling with a total draft of at least 80% in such a manner that its rolling end temperature exceeds $Ar_3+50°$ C., setting two desired temperatures $T_1$ and $T_2$, wherein $T_1 \geqq T_2$ within a temperature range from the $Ar_3$ of the steel to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

(21) A process as described in (20), wherein cooling is conducted for 3 to 25 seconds to cool said steel within a temperature range from said desired temperature $T_1$ to said desired temperature $T_2$ or to hold said steel isothermally within said temperature range.

(22) A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal, with S being limited to not more than 0.010% by weight and the balance being iron and inevitable impurities, to a hot finish rolling with a total draft of at least 80% in such a manner that its rolling end temperature exceeds $Ar_3+50°$ C., setting two desired temperatures $T_1$ and $T_2$, wherein $T_1 \geqq T_2$ within a temperature range from the $Ar_3$ of the steel to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

(23) A process as described in (22), wherein cooling is conducted for 3 to 25 seconds to cool said steel within a temperature range from said desired temperature $T_1$ to said desired temperature $T_2$ or to hold said steel isothermally within said temperature range.

(24) A process as described in any one of (8) to (23), wherein a hot finish rolling starting temperature of the steel is set to not more than ($Ar_3$+100° C.).

(25) A process as described in any one of (8) to (23), wherein the steel sheet after the coiling is cooled down to not more than 200° C. at a cooling rate of 30° C./hr. or more.

(26) A process as described in any one of (8) to (23), wherein said steel further contains 0.004 to 0.040% by weight of Al.

(27) A process as described in any one of (8) to (23), wherein said steel further contains 0.004 to 0.040% by weight of Al and a hot finish rolling starting temperature of the steel is set to not more than ($Ar_3$+100° C.).

(28) A process as described in any one of (8) to (23), wherein said steel further contains 0.004 to 0.040% by weight of Al and the steel sheet after the coiling is cooled down to not more than 200° C. at a cooling rate of 30° C./hr. or more.

BRIEF DESCRIPTION OF THE DRAWINGS

FIGS. 8–9 illustrate the "uniform elongation" and "total elongation" of the steel sheet, in which, when a test piece of steel sheet is elongated in a tensile test machine [see FIG. 8(*a*)], first it is uniformly elongated [see FIG. 8(*b*)], and then a neck portion is formed at a local portion of the test piece [see FIG. 8(*c*)], and finally it is completely ruptured, and thus, a total elongation is a uniform elongation plus a local elongation (see FIG. 9).

DETAILED DESCRIPTION OF THE INVENTION

Figure 1:
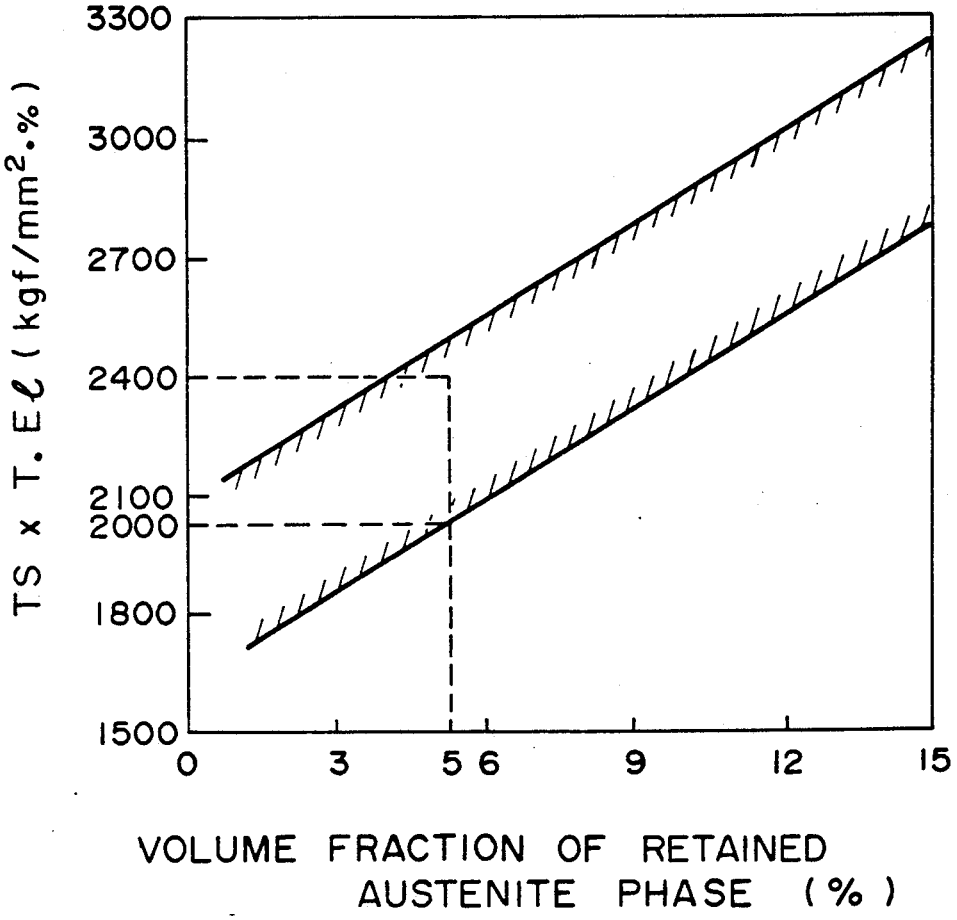
FIG. 1 is a diagram showing a relationship between the volume fraction of the retained austenite phase and the TS×T.El value.

The requisite means for achieving the present invention will be explained below. First, the contents of the chemical components of the present steel sheet will be described in detail below:

C is an indispensable element for the intensification of the steel and below 0.15% by weight of C the retained austenite phase that acts to increase the ductility of the present steel cannot be fully obtained, whereas above 0.4% by weight of C the weldability is deteriorated and the steel is embrittled. Thus, 0.15 to 0.4% by weight of C must be added.

Si is effective for the formation and purification of the ferrite phase that contributes to an increase in the ductility with increasing Si content, and is also effective for the enrichment of C into the untransformed austenite phase to obtain a retained austenite phase. Below 0.5% by weight of Si this effect is not fully obtained, whereas above 2% by weight of Si this effect is saturated and the scale properties and the weldability are deteriorated. Thus, 0.5 to 2.0% by weight of Si must be added.

Mn contributes, as is well known, to the retaining of the austenite phase as an austenite-stabilizing element.

Below 0.5% by weight of Mn the effect is not fully obtained, whereas above 2% by weight of Mn the effect is saturated, resulting in adverse effects, such as deterioration of the weldability, etc. Thus, 0.5 to 2.0% by weight of Mn must be added.

Al is preferably added to the steel for deoxidation of the steel, in which case it is added in an amount of 0.004 to 0.040% by weight. Below 0.004% by weight of Al, the desired effect is not fully obtained, whereas above 0.040% by weight of Al the effect is saturated, resulting in an economically adverse effect.

S is a detrimental element to the hole expansibility. Above 0.010% by weight of S the hole expansibility is deteriorated. Thus, the S content must be decreased to not more than 0.010% by weight, and not more than 0.001% by weight of S is preferable.

In order to improve the hole expansibility, it is effective to reduce the S content, thereby reducing the content of sulfide-based inclusions and also to spheriodize the inclusions. For the spheriodization it is effective to add Ca or rare earth metal, which will be hereinafter referred to as "REM". Below 0.0005% by weight of Ca and 0.0050% by weight of REM, the spheroidization effect is not remarkable, whereas above 0.0100% by weight of Ca and 0.050% by weight of REM the spheroidization effect is saturated and the content of the inclusions are rather increased as an adverse effect. Thus, 0.0005 to 0.0100% by weight of Ca or 0.005 to 0.050% by weight of REM must be added.

Cr, V, Nb and Ti are elements which form carbides. Therefore, it is necessary that such an element is not intentionally added to the present steel as a carbide former.

The microstructure of the present steel sheet will be described in detail below.

On the basis of steel species A in the Example that follows, steel sheets were produced according to the present processes described as the means for attaining the object of the present invention, the means being composed of a fundamental idea in which the publicly known TR.I.P. (TRansformation Induced Plasticity) phenomenon is utilized. The TR.I.P. phenomenon means the following: when a steel sheet is subjected to working, a retained austenite is transformed into a martensite so that the steel sheet becomes hardened; and as a result, formation of a constriction, which would be formed at a local portion of the steel sheet by the working, is prevented, so that uniform elongation of the steel sheet is greatly improved and further it becomes hard to cause a rupture of the steel sheet by the working, resulting in the improvement of the total elongation of the steel sheet. The microstructure of the steel sheet which utilizes this TR.I.P. phenomenon is such that austenite, which is unstable for working carried out at ordinary temperature (which is transformed into martensite by being subjected to the working), is retained. In order to concretely establish the above-mentioned means, steel sheets were produced by various manufacturing processes, and also under the conditions approximate to those of the present processes, and such steel sheets were investigated. As a result, the present inventors have found the following facts.

In order to improve the ductility of steel sheets, it is necessary to form 5% by volume or more of a retained austenite phase in the present invention and it is desirable to stabilize the austenite phase through the enrichment of such elements as C, etc. To this effect, it is necessary (1) to form a ferrite phase, thereby promoting the enrichment of such elements as C, etc. into the austenite phase and contributing to the retaining of the austenite phase and (2) to promote the enrichment of such elements as C, etc. into the austenite phase with the progress of bainite phase transformation, thereby contributing to the retaining of the austenite phase.

In order to promote the enrichment of such elements as C, etc. into the austenite phase through the formation of the ferrite phase, thereby contributing to the retaining of the austenite phase, it is necessary to increase the ferrite volume fraction, and to make the ferrite grains finer, because the sites at which the C concentration is highest and the austenite phase is liable to be retained are the boundaries between the ferrite phase and the untransformed austenite phase, and the boundaries can be increased with increasing ferrite volume fraction and decreasing ferrite grain size.

Figure 2:
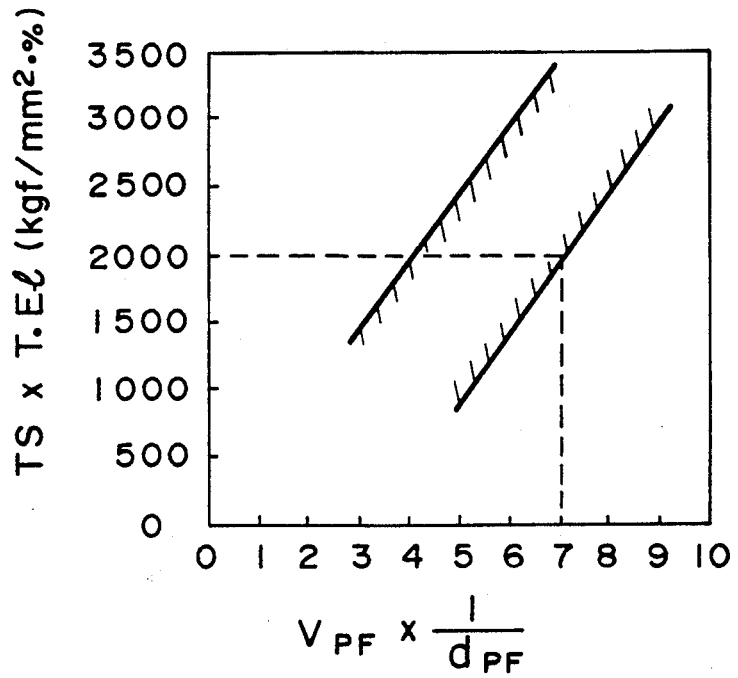
FIG. 2 is a diagram showing a relationship between the ratio of polygonal ferrite volume fraction $V_{PF}$(%) to polygonal ferrite average grain size $d_{PF}$(μm) and the TS×T.El value.

In order at least to obtain $TS \times T.El > 2{,}000$ assuredly, it has been found that the ratio $V_{PF}/d_{PF}$, i.e. a ratio of polygonal ferrite volume fraction $V_{PF}$ (%) to polygonal ferrite grain size $d_{PF}$(μm), must be 7 or more, as obvious from FIG. 2 showing the test results obtained under the same conditions as in FIG. 1. Polygonal ferrite volume fraction and polygonal ferrite average grain size are determined on optical microscope pictures. Ferrite grain whose axis ratio (long axis/short axis) = 1 to 3, is defined as polygonal ferrite.

Besides the ferrite phase and the retained austenite phase, the remainder must be a bainite phase that contributes to the concentration of such elements as C, etc. into the austenite phase, because C is enriched into the untransformed austenite phase with the progress of the bainite phase transformation, thereby stabilizing the austenite phase, that is, the bainite phase has a good effect upon the retaining of the austenite phase. It is necessary not to form any pearlite phase or martensite phase that reduce the retained austenite phase.

The process of the present invention will be described in detail below:

In order to increase the ferrite volume fraction $V_{PF}$, low temperature rolling, rolling under a high pressure, and isothermal holding or slow cooling at a temperature around the nose temperature for the ferrite phase transformation (from $Ar_1$ to $Ar_3$) on a cooling table after the finish rolling, where the nose temperature for the ferrite phase transformation means a temperature at which the isothermal ferrite phase transformation starts and ends within a minimum time, are effective steps.

In order to make the ferrite grains finer, that is, to reduce $d_{PF}$, low temperature rolling, rolling under a high reduction, rapid cooling around the $Ar_3$ transformation point and rapid cooling after the ferrite phase transformation to avoid grain growth are effective steps. Thus, processes based on combinations of the former steps with the latter steps can be utilized.

Rolling temperature:

In order to increase the ferrite volume fraction and make the ferrite grains finer, low temperature rolling is effective. At a temperature lower than ($Ar_3 - 50°$ C.), the deformed ferrite is increased, deteriorating the ductility, whereas at a temperature higher than ($Ar_3 + 50°$ C.) the ferrite phase is not thoroughly formed. Thus, the effective finish rolling end temperature is any temperature within a range between ($Ar_3 + 50°$ C.) and ($Ar_3 - 50°$ C.). Furthermore, the ferrite formation and the refinement of ferrite grains can be promoted by setting the finish rolling start temperature to a temperature not higher than ($Ar_3 + 100°$ C.).

However, the low temperature rolling has operational drawbacks such as an increase in the rolling load, a difficulty in controlling the shape of the sheet, etc. when a thin steel sheet (sheet thickness $\leqq 2$ mm) is rolled, and particularly when a high carbon equivalent material or a high alloy material with a high deformation resistance is rolled. Thus, it is also effective to form the ferrite phase and make the ferrite grains finer by controlling the cooling on a cooling table after the hot finish rolling, as will be described later. In that case, a hot finish rolling end temperature exceeding $Ar_3 + 50°$ C. will not increase the aforementioned effect, but must be often employed on operational grounds.

Draft:

The formation of the ferrite phase and the refinement of finer ferrite grains can be promoted by making the total draft 80% or more in the hot finish rolling and a steel sheet with a good formability can be obtained thereby. Thus, the lower limit to the total draft is 80%.

Figure 6:
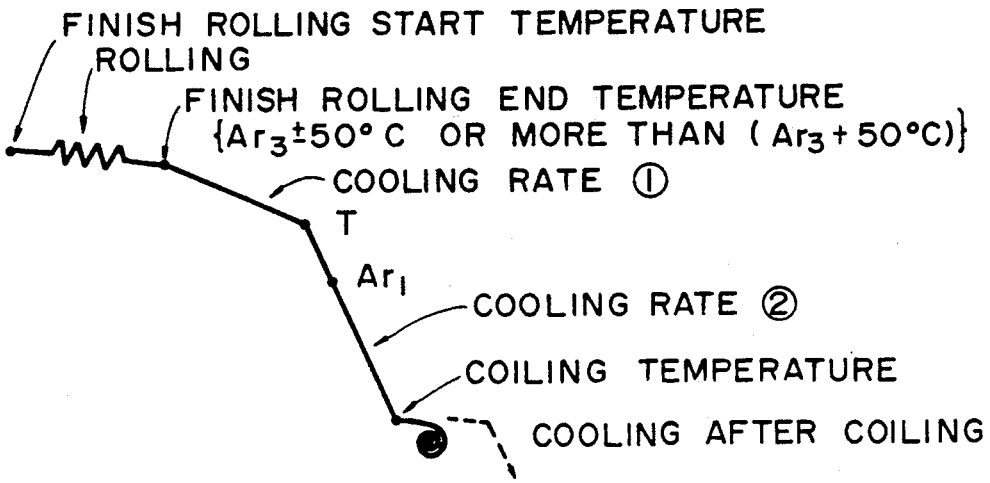
FIG. 6 is a temperature pattern diagram showing a relationship among the finish rolling end temperature, the cooling rate ①, T and the cooling rate ②.

Cooling:

Necessary ferrite formation and C enrichment for retaining the austenite phase are not fully carried out by cooling between $Ar_3$ and $Ar_1$ at a cooling rate of 40° C./sec. or more after the hot rolling, and thus a step is carried out to cool or hold isothermally the steel down to T ($Ar_1 < T \leqq$ lower temperature of $Ar_3$ or the rolling end temperature) at a cooling rate of less than 40° C./sec. along the temperature pattern, as shown in FIG. 6, after the hot rolling. More preferably, it is necessary that cooling is carried out for 3 to 25 seconds to cool the steel within a temperature range from the lower one of the $Ar_3$ or the rolling end temperature to the temperature T or to hold the steel isothermally within said temperature range. When the cooling or the isothermal holding is carried out for 3 seconds or more, the ferrite formation and C enrichment are more sufficiently carried out. When the time of the cooling or isothermal holding exceeds 25 seconds, the length of the line from a finish rolling mill to a coiling machine becomes remarkably long. Thus, the upper limit to the time is 25 seconds. Incidentally, as means for conducting the cooling at a cooling rate of less than 40° C./sec. or the isothermal holding, there are a heat-holding equipment using electric power, gas, oil and the like, a heat-insulating cover using heat-insulating material and the like, etc. A more desirable cooling pattern is as given in FIG. 7: the ferrite grains formed through the ferrite transformation can be made finer and the growth of grains including the ferrite grains, formed during the hot rolling, can be suppressed by carrying out the cooling down to $T_1$ ($Ar_1 < T <$ lower one of $Ar_3$ or the rolling end temperature) at a cooling rate of 40° C./sec. or more after the hot rolling; and after that, the ferrite volume fraction can be increased around the ferrite transformation nose by carrying out the cooling down to $T_2$ ($Ar_1 < T_2 \leqq T_1$) at a cooling rate of less than 40° C./sec. or the isothermal holding, more preferably by carrying out the cooling or the isothermal holding within a temperature range from the temperature $T_1$ to the temperature $T_2$ for 3 to 25 seconds. In this manner, a steel sheet with a better formability can be obtained.

At a temperature above $Ar_3$, no ferrite phase is formed even with cooling at a cooling rate of less than 40° C./sec. or conducting the isothermal holding, and a pearlite phase is formed by cooling down to a temperature below $Ar_1$ at a cooling rate of less than 40° C./sec. or by conducting the isothermal holding at a temperature below $Ar_1$. Thus, $Ar_1 < T_2 \leqq T_1 <$ (the lower one of $Ar_3$ or the finish rolling end temperature) is determined.

The successive cooling rate down to the coiling temperature is 40° C./sec. or more from the viewpoint of avoiding formation of a pearlite phase and suppressing the grain growth. In case that the finish rolling end temperature is between not more than the $Ar_3$ and above the ($Ar_3 - 50°$ C.), some deformed ferrite is formed. On the other hand, it is effective in recovering the ductility of the deformed ferrite that the step of cooling at a rate of less than 40° C./sec. is performed within a temperature range from the finish rolling end temperature to more than $Ar_1$. More preferably, it is effective that the cooling or isothermal holding is conducted for 3 to 25 seconds.

Figure 4:
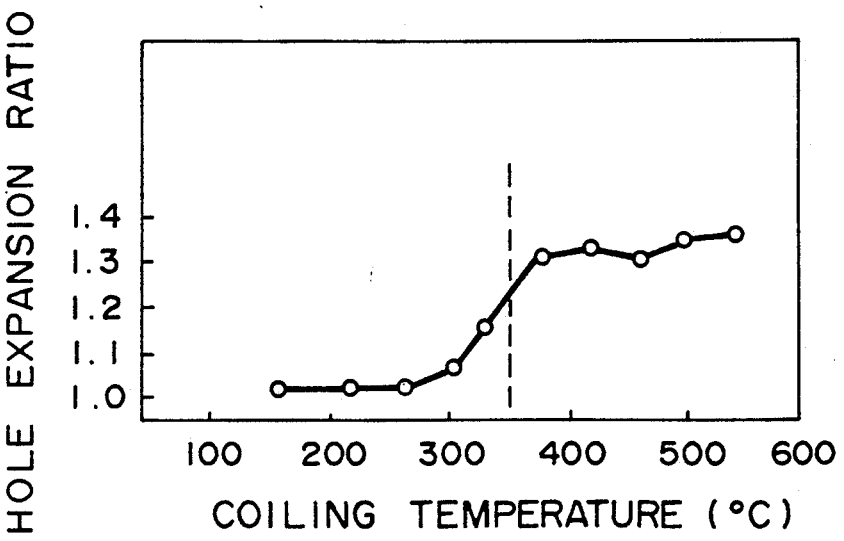
FIG. 4 is a diagram showing a relationship between the coiling temperature and the hole expansion ratio.
Figure 3:
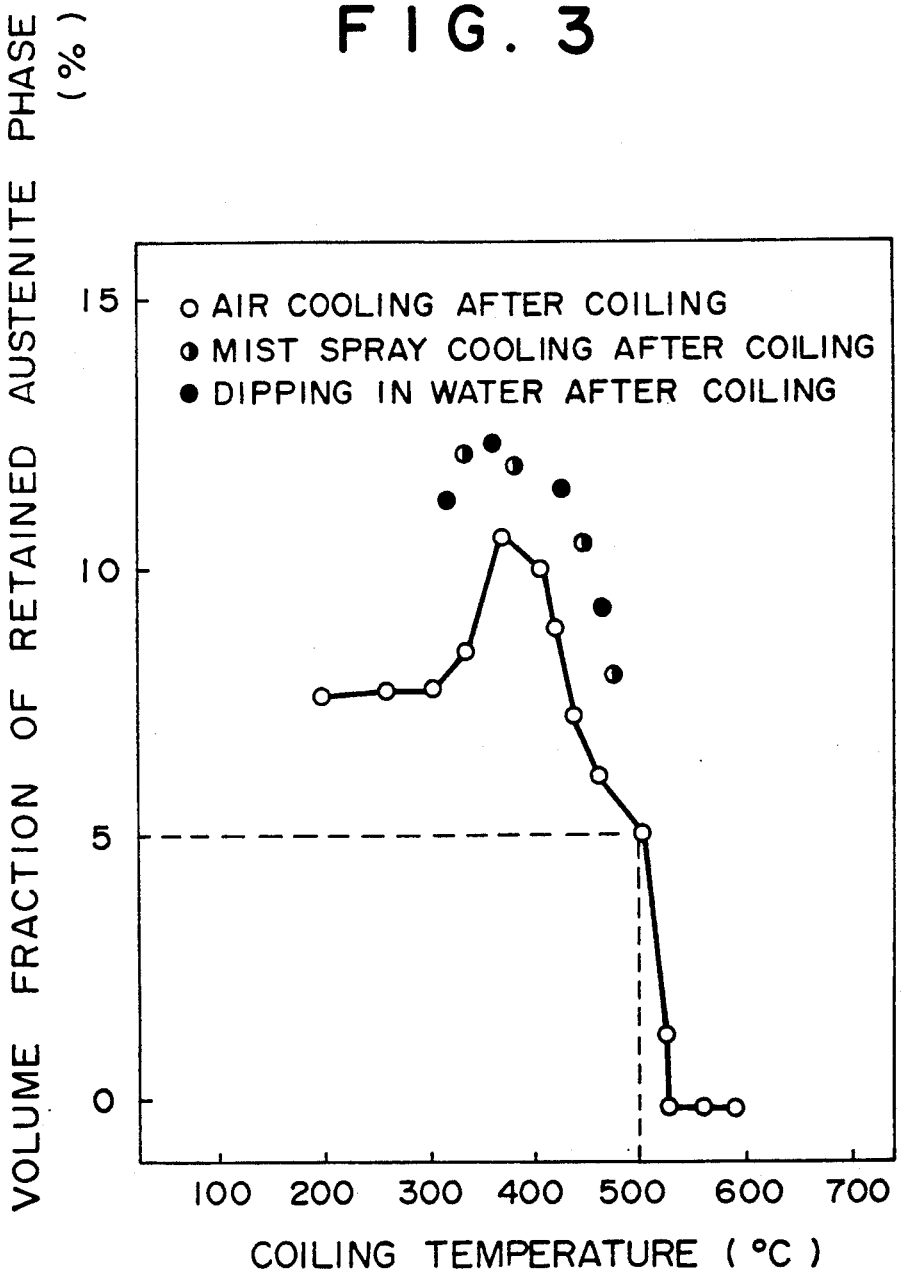
FIG. 3 is a diagram showing a relationship between the coiling temperature and the volume fraction of the retained austenite phase.

Results of rolling and cooling tests for steel species A that follows while changing the coiling temperature are shown in FIG. 3 and FIG. 4.

When the coiling temperature exceeds 500° C., the bainite transformation excessively proceeds after the coiling, or a pearlite phase is formed, and consequently 5% by volume or more of the retained austenite phase cannot be obtained, as shown in FIG. 3. Thus, the upper limit to the coiling temperature is 500° C. When the coiling temperature is not more than 350° C., martensite is formed to deteriorate the hole expansibility, as shown in FIG. 4. Thus, the lower limit to the coiling temperature is over 350° C.

In order to avoid excessive bainite transformation and retain a larger amount of the austenite phase, it is more effective to cool the steel sheet down to 200° C. or less at a cooling rate of 30° C./hr. or more by dipping in water, mist spraying, etc. after the coiling as shown in FIG. 3.

Figure 7:
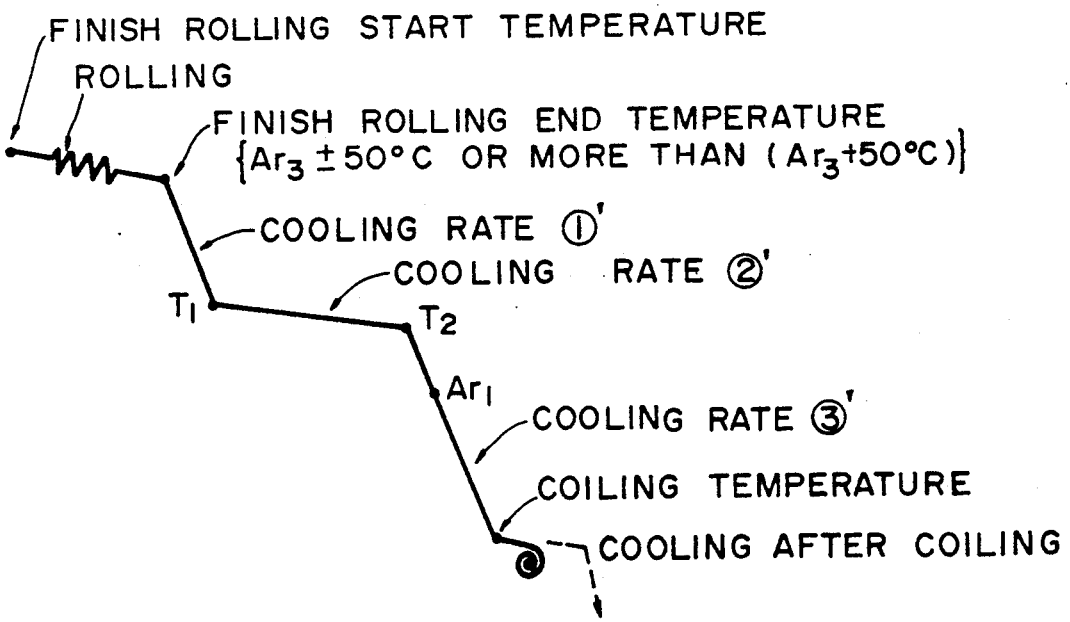
FIG. 7 is a temperature pattern diagram showing a relationship among the finish rolling end temperature, the cooling rate ①', $T_1$, the cooling rate ②', $T_2$ and the cooling rate ③'.

The present processes based on combinations of the foregoing steps are shown in FIG. 6 and FIG. 7, where the finish rolling end temperature is further classified into two groups, i.e. a lower temperature range ($Ar_3 \pm 50°$ C.) and a higher temperature range {more than ($Ar_3 + 50°$ C.)}. Besides the foregoing 4 processes, a process in which the upper limit to the hot finish rolling start temperature is $Ar_3 + 100°$ C. or less and a process in which the cooling step after the coiling is limited or a process based on a combination of these two steps are available. Needless to say, a better effect can be obtained by a multiple combination of these process steps.

PREFERRED EMBODIMENTS OF THE INVENTION

The present invention will be described in detail, referring to an Example.

EXAMPLE

Steel sheets having a thickness of 1.4 to 6.0 mm were produced from steel species A to U having chemical components given in Table 1 under the conditions given in Tables 2–4 according to the process pattern given in FIG. 6 or FIG. 7, where the steel species C shows those whose C content is below the lower limit of the present invention, and the steel species F and I show those whose Si content is below the lower limit of the present invention and those whose Mn content is below the lower limit of the present invention, respectively.

The symbols given in Tables 2–4 have the following meanings:

$FT_0$: finish rolling start temperature (°C.)
$FT_7$: finish rolling end temperature (°C.)
CT: coiling temperature (°C.)
TS: tensile strength (kgf/mm$^2$)
T.El: total elongation (%)
$\gamma_R$: volume fraction of retained austenite (%)
$V_{PF}$: polygonal ferrite volume fraction (%)
$d_{PF}$: polygonal ferrite grain size (μm).

In Table 1, the $Ar_1$ temperature of steel species A was 650° C. and the $Ar_3$ temperature of this species was 800° C.

The steel species according to the present invention are Nos. 1, 2, 4, 5, 7, 8, 10, 23 to 40, 42, 45, 46, 47, 49, 51, 52, 54, 55, and 57 to 80.

Figure 5:
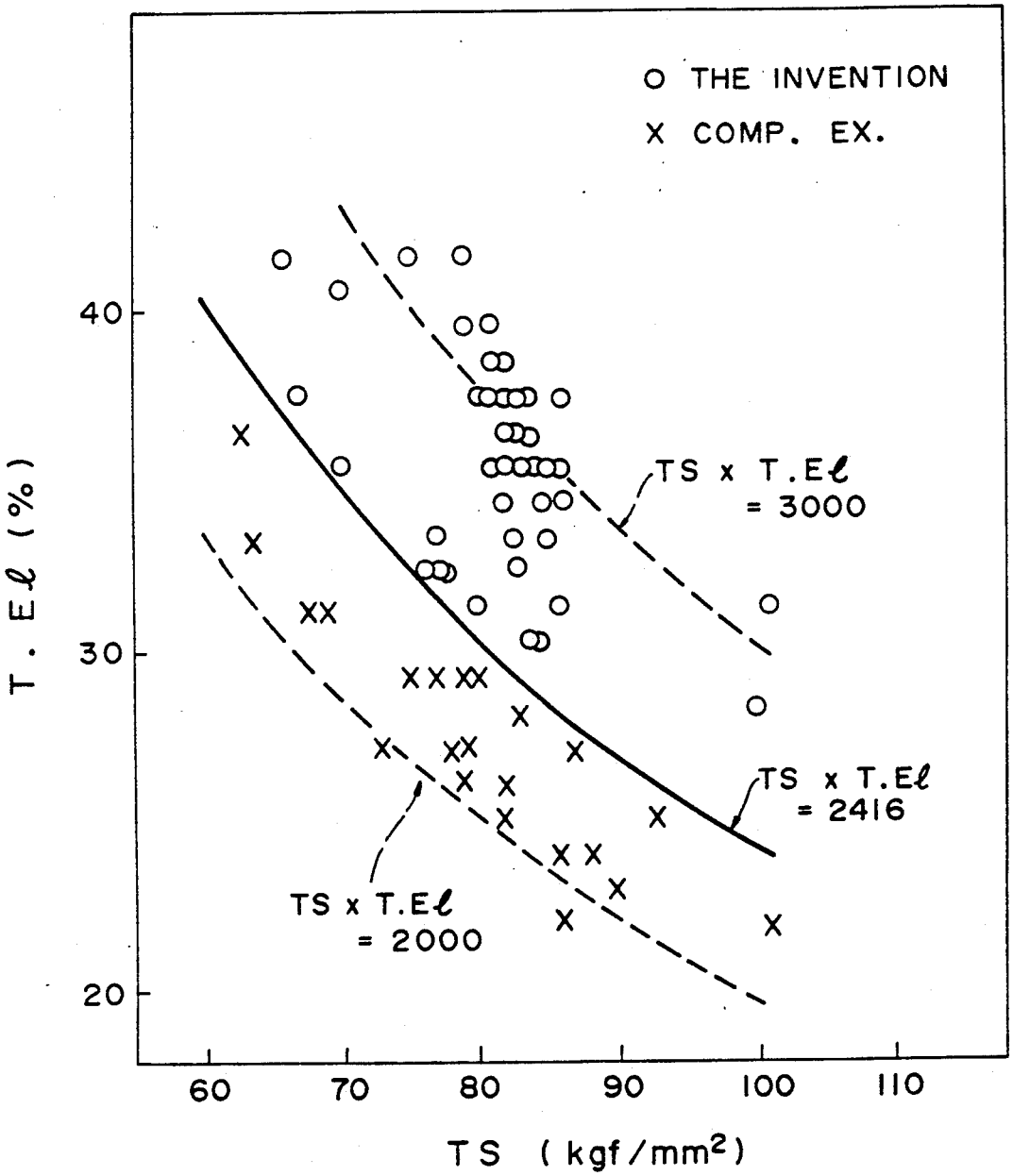
FIG. 5 is a diagram showing a relationship between TS and T.El.

Initially TS×T.El≧2,000 was aimed at, whereas much better strength-ductility balance such as TS×T.El>2,416 was obtained owing to the synergistic effect, as shown in FIG. 5. Particularly, Nos. 61 to 64, and 79 to 80, which are directed to steel species containing Ca, show that the amount of uniform elongation is 20% or more, and the amount of total elongation is 30% or more, and further the fluctuation of TS×El is small, so Nos. 61 to 64, 79 and 80 are steel species for working which are excellent especially in terms of a balance of strength and ductility.

In comparative Examples, no good ductility was obtained on the following individual grounds;

Nos. 3 and 56: the C content was too low.
Nos. 6 and 50: the Si content was too low.
Nos. 9 and 53: the Mn content was too low.
No. 11: the total draft was too low at the finish rolling.
No. 12: the finish rolling end temperature was too low.
No. 13: the temperature T was too high.
Nos. 14, 15, 16 and 48: the temperatures T and $T_2$ were too low.
Nos. 17 and 41: the cooling rate ① was too high.
Nos. 18 and 43: the cooling rate ② was too low.
No. 19: the cooling rate ②′ was too high.
No. 20: the cooling rate ③′ was too low.
Nos. 21 and 44: the coiling temperature was too high.
No. 22: the coiling temperature was too low.

Furthermore, Nos. 26, 29, 33, 37 and 40 are examples of controlling the rolling start temperature and controlling the cooling step after the coiling, and Nos. 65 to 70 are examples of conducting the isothermal holding step in the course of the cooling step.

TABLE 1

| Steel Species | Components (wt %) C | Si | Mn | P | S | Al | Ca | REM |
|---|---|---|---|---|---|---|---|---|
| A | 0.20 | 1.5 | 1.5 | 0.015 | 0.001 | — | — | — |
| B | 0.16 | 1.0 | 1.2 | 0.019 | 0.002 | — | — | — |
| C | 0.14 | 1.0 | 1.2 | 0.020 | 0.003 | — | — | — |
| D | 0.40 | 1.5 | 0.80 | 0.018 | 0.002 | — | — | — |
| E | 0.20 | 0.6 | 1.80 | 0.012 | 0.002 | — | — | — |
| F | 0.20 | 0.4 | 1.80 | 0.010 | 0.001 | — | — | — |
| G | 0.19 | 2.0 | 1.0 | 0.015 | 0.003 | — | — | — |
| H | 0.20 | 1.6 | 0.6 | 0.018 | 0.001 | — | — | — |
| I | 0.20 | 1.6 | 0.4 | 0.016 | 0.002 | — | — | — |
| J | 0.19 | 0.8 | 2.0 | 0.021 | 0.003 | — | — | — |
| K | 0.19 | 1.5 | 1.5 | 0.020 | 0.003 | — | — | 0.006 |

TABLE 1-continued

| Steel Species | Components (wt %) C | Si | Mn | P | S | Al | Ca | REM |
|---|---|---|---|---|---|---|---|---|
| L | 0.21 | 1.4 | 1.6 | 0.015 | 0.001 | — | 0.003 | — |
| M | 0.20 | 1.4 | 1.5 | 0.015 | 0.001 | 0.028 | — | — |
| N | 0.16 | 1.0 | 1.3 | 0.019 | 0.002 | 0.015 | — | — |
| O | 0.40 | 1.5 | 0.80 | 0.016 | 0.002 | 0.012 | — | — |
| P | 0.20 | 0.6 | 1.80 | 0.011 | 0.002 | 0.027 | — | — |
| Q | 0.19 | 2.0 | 1.1 | 0.015 | 0.003 | 0.028 | — | — |
| R | 0.20 | 1.7 | 0.6 | 0.018 | 0.001 | 0.025 | — | — |
| S | 0.19 | 0.8 | 2.0 | 0.021 | 0.002 | 0.030 | — | — |
| T | 0.19 | 1.5 | 1.6 | 0.020 | 0.003 | 0.022 | — | 0.006 |
| U | 0.21 | 1.4 | 1.7 | 0.015 | 0.001 | 0.034 | 0.003 | — |

TABLE 2

| Item | No. | Steel species | Total draft at finishing (%) | $FT_0$ (°C.) | $FT_7$ (°C.) | T (°C.) | $T_1$ (°C.) | $T_2$ (°C.) | Cooling rate (°C./s) ① | ② | ①' | ②' | ③' | CT (°C.) | Cooling after coiling |
|---|---|---|---|---|---|---|---|---|---|---|---|---|---|---|---|
| The invention | 1 | A | 85 | 890 | 800 | — | 750 | 655 | — | — | 50 | 20 | 50 | 390 | Air cooling |
| The invention | 2 | B | 80 | 895 | 830 | — | 770 | 660 | — | — | 60 | 30 | 55 | 370 | Air cooling |
| Comp. Ex. | 3 | C | 80 | 895 | 790 | — | 750 | 670 | — | — | 55 | 15 | 50 | 450 | 40°C./hr |
| The invention | 4 | D | 81 | 880 | 825 | — | 700 | 650 | — | — | 85 | 25 | 80 | 470 | Air cooling |
| The invention | 5 | E | 85 | 885 | 810 | — | 755 | 695 | — | — | 70 | 25 | 70 | 370 | Air cooling |
| Comp. Ex. | 6 | F | 80 | 900 | 795 | — | 720 | 670 | — | — | 65 | 20 | 60 | 380 | 40° C./hr |
| The invention | 7 | G | 85 | 895 | 815 | — | 735 | 665 | — | — | 80 | 30 | 80 | 375 | Air cooling |
| The invention | 8 | H | 83 | 870 | 790 | — | 720 | 665 | — | — | 80 | 30 | 75 | 390 | Air cooling |
| Comp. Ex. | 9 | I | 80 | 890 | 805 | — | 750 | 700 | — | — | 75 | 25 | 65 | 410 | 40° C./hr |
| The invention | 10 | J | 87 | 880 | 785 | — | 725 | 675 | — | — | 70 | 20 | 65 | 430 | Air cooling |
| Comp. Ex. | 11 | A | 75 | 905 | 855 | 770 | — | — | 30 | 50 | — | — | — | 400 | 40° C./hr |
| Comp. Ex. | 12 | A | 85 | 895 | 745 | — | 700 | 655 | — | — | 60 | 20 | 55 | 390 | 40° C./hr |
| Comp. Ex. | 13 | A | 80 | 910 | 860 | 810 | — | — | 20 | 60 | — | — | — | 415 | 40° C./hr |
| Comp. Ex. | 14 | A | 80 | 905 | 865 | 630 | — | — | 15 | 55 | — | — | — | 385 | 40° C./hr |
| Comp. Ex. | 15 | A | 88 | 910 | 850 | — | 800 | 630 | — | — | 60 | 20 | 55 | 420 | 40° C./hr |
| Comp. Ex. | 16 | A | 85 | 910 | 810 | — | 700 | 640 | — | — | 85 | 30 | 75 | 400 | 40° C./hr |
| Comp. Ex. | 17 | A | 84 | 895 | 860 | 760 | — | — | 45 | 80 | — | — | — | 375 | 40° C./hr |
| Comp. Ex. | 18 | A | 90 | 890 | 855 | 750 | — | — | 20 | 35 | — | — | — | 380 | 35° C./hr |
| Comp. Ex. | 19 | A | 91 | 895 | 855 | — | 720 | 655 | — | — | 85 | 45 | 80 | 390 | 40° C./hr |
| Comp. Ex. | 20 | A | 89 | 880 | 815 | — | 740 | 665 | — | — | 60 | 30 | 35 | 370 | 40° C./hr |
| Comp. Ex. | 21 | A | 85 | 905 | 790 | — | 730 | 660 | — | — | 60 | 25 | 55 | 520 | Air cooling |
| Comp. Ex. | 22 | A | 93 | 910 | 785 | — | 720 | 655 | — | — | 75 | 30 | 70 | 330 | Air cooling |
| The invention | 23 | A | 87 | 915 | 800 | 750 | — | — | 30 | 65 | — | — | — | 400 | Air cooling |
| The invention | 24 | A | 84 | 895 | 815 | 720 | — | — | 20 | 60 | — | — | — | 415 | Air cooling |
| The invention | 25 | A | 85 | 905 | 840 | 765 | — | — | 25 | 50 | — | — | — | 500 | 40° C./hr |
| The invention | 26 | A | 90 | 895 | 825 | 740 | — | — | 15 | 50 | — | — | — | 350 | 35° C./hr |
| The invention | 27 | A | 85 | 910 | 830 | — | 740 | 655 | — | — | 50 | 30 | 45 | 385 | Air cooling |
| The invention | 28 | A | 92 | 905 | 820 | — | 770 | 690 | — | — | 70 | 35 | 65 | 425 | 40° C./hr |
| The invention | 29 | A | 93 | 890 | 850 | — | 765 | 675 | — | — | 55 | 15 | 50 | 465 | 40° C./hr |
| The invention | 30 | A | 90 | 910 | 855 | 755 | — | — | 35 | 75 | — | — | — | 370 | Air cooling |
| The invention | 31 | A | 90 | 895 | 860 | 770 | — | — | 20 | 45 | — | — | — | 470 | Air cooling |
| The invention | 32 | A | 80 | 905 | 855 | 650 | — | — | 20 | 55 | — | — | — | 455 | 40° C./hr |
| The invention | 33 | A | 85 | 900 | 865 | 800 | — | — | 15 | 50 | — | — | — | 395 | 35° C./hr |
| The invention | 34 | A | 85 | 915 | 860 | — | 800 | 700 | — | — | 60 | 20 | 55 | 370 | Air cooling |
| The invention | 35 | A | 90 | 895 | 870 | — | 750 | 655 | — | — | 65 | 20 | 65 | 390 | Air cooling |
| The invention | 36 | A | 85 | 905 | 875 | — | 765 | 680 | — | — | 65 | 20 | 65 | 410 | 40° C./hr |
| The invention | 37 | A | 80 | 900 | 875 | — | 770 | 660 | — | — | 55 | 15 | 55 | 415 | 40° C./hr |

| Item | No. | TS (kgf/mm²) | T.El (%) | U.El (%) | γR (%) | $V_{PF}/d_{PF}$ | TS × T.El |
|---|---|---|---|---|---|---|---|
| The invention | 1 | 81 | 38 | 26 | 14 | 8.8 | 3078 |
| The invention | 2 | 66 | 41 | 26 | 13 | 7.4 | 2706 |
| Comp. Ex. | 3 | 63 | 36 | 21 | 4 | 7.2 | 2268 |
| The invention | 4 | 101 | 31 | 21 | 13 | 8.0 | 3131 |
| The invention | 5 | 79 | 39 | 26 | 13 | 8.3 | 3081 |
| Comp. Ex. | 6 | 77 | 29 | 16 | 3 | 7.5 | 2233 |
| The invention | 7 | 75 | 41 | 28 | 14 | 7.5 | 3075 |
| The invention | 8 | 70 | 40 | 27 | 14 | 7.7 | 2800 |
| Comp. Ex. | 9 | 68 | 31 | 16 | 4 | 7.6 | 2108 |
| The invention | 10 | 83 | 37 | 25 | 13 | 7.9 | 3071 |
| Comp. Ex. | 11 | 82 | 25 | 12 | 3 | 5.2 | 2050 |
| Comp. Ex. | 12 | 86 | 22 | 10 | 4 | 8.5 | 1892 |
| Comp. Ex. | 13 | 90 | 23 | 12 | 4 | 6.5 | 2070 |
| Comp. Ex. | 14 | 79 | 26 | 13 | 3 | 7.7 | 2054 |
| Comp. Ex. | 15 | 79 | 27 | 14 | 4 | 6.8 | 2133 |
| Comp. Ex. | 16 | 80 | 29 | 17 | 4 | 8.0 | 2320 |
| Comp. Ex. | 17 | 88 | 24 | 12 | 2 | 6.3 | 2112 |
| Comp. Ex. | 18 | 82 | 26 | 14 | 2 | 8.1 | 2132 |
| Comp. Ex. | 19 | 87 | 27 | 15 | 4 | 6.2 | 2349 |
| Comp. Ex. | 20 | 79 | 29 | 16 | 4 | 7.3 | 2291 |
| Comp. Ex. | 21 | 83 | 28 | 16 | 3 | 7.5 | 2324 |
| Comp. Ex. | 22 | 93 | 25 | 14 | 3 | 7.6 | 2325 |
| The invention | 23 | 82 | 35 | 23 | 12 | 7.7 | 2870 |

TABLE 2-continued

| | | | | | | | |
|---|---|---|---|---|---|---|---|
| The invention | 24 | 81 | 37 | 25 | 13 | 8.0 | 2997 |
| The invention | 25 | 82 | 38 | 26 | 13 | 8.1 | 3116 |
| The invention | 26 | 86 | 37 | 25 | 15 | 8.1 | 3182 |
| The invention | 27 | 85 | 35 | 23 | 14 | 7.3 | 2975 |
| The invention | 28 | 81 | 39 | 27 | 15 | 8.1 | 3159 |
| The invention | 29 | 79 | 41 | 28 | 16 | 8.8 | 3239 |
| The invention | 30 | 84 | 30 | 20 | 6 | 7.2 | 2520 |
| The invention | 31 | 82 | 34 | 22 | 11 | 7.4 | 2788 |
| The invention | 32 | 83 | 35 | 23 | 12 | 8.0 | 2905 |
| The invention | 33 | 82 | 36 | 24 | 14 | 7.9 | 2952 |
| The invention | 34 | 85 | 33 | 21 | 11 | 7.7 | 2805 |
| The invention | 35 | 83 | 35 | 23 | 12 | 7.8 | 2905 |
| The invention | 36 | 84 | 35 | 23 | 13 | 8.0 | 2940 |
| The invention | 37 | 83 | 37 | 25 | 14 | 8.1 | 3071 |

| Item | No. | Steel species | Total draft at finishing (%) | $FT_0$ (°C.) | $FT_7$ (°C.) | T (°C.) | $T_1$ (°C.) | $T_2$ (°C.) | Cooling rate (°C./s) ① | ② | ①' | ②' | ③' | CT (°C.) | Cooling after coiling |
|---|---|---|---|---|---|---|---|---|---|---|---|---|---|---|---|
| The invention | 38 | A | 80 | 910 | 865 | 700 | — | — | 20 | 50 | — | — | — | 360 | Air cooling |
| The invention | 39 | A | 82 | 890 | 850 | 690 | — | — | 35 | 45 | — | — | — | 370 | Air cooling |
| The invention | 40 | A | 83 | 890 | 850 | 690 | — | — | 35 | 45 | — | — | — | 370 | 40° C./hr |
| Comp. Ex. | 41 | A | 85 | 900 | 850 | — | — | — | 45 | 45 | — | — | — | 370 | 40° C./hr |
| The invention | 42 | A | 86 | 950 | 870 | 660 | — | — | 15 | 45 | — | — | — | 490 | Air cooling |
| Comp. Ex. | 43 | A | 90 | 950 | 870 | 680 | — | — | 15 | 35 | — | — | — | 490 | Air cooling |
| Comp. Ex. | 44 | A | 91 | 950 | 870 | 680 | — | — | 15 | 45 | — | — | — | 510 | Air cooling |
| The invention | 45 | A | 85 | 940 | 860 | 660 | — | — | 20 | 80 | — | — | — | 420 | Air cooling |
| The invention | 46 | A | 90 | 960 | 900 | 720 | — | — | 15 | 70 | — | — | — | 430 | Air cooling |
| The invention | 47 | D | 90 | 890 | 850 | 650 | — | — | 15 | 50 | — | — | — | 400 | Air cooling |
| Comp. Ex. | 48 | D | 92 | 920 | 850 | 630 | — | — | 15 | 50 | — | — | — | 400 | Air cooling |
| The invention | 49 | E | 95 | 950 | 860 | 680 | — | — | 20 | 60 | — | — | — | 390 | Air cooling |
| Comp. Ex. | 50 | F | 95 | 900 | 860 | 680 | — | — | 20 | 60 | — | — | — | 390 | Air cooling |
| The invention | 51 | G | 90 | 940 | 850 | 710 | — | — | 10 | 45 | — | — | — | 380 | Air cooling |
| The invention | 52 | H | 82 | 945 | 865 | 690 | — | — | 15 | 55 | — | — | — | 400 | Air cooling |
| Comp. Ex. | 53 | I | 85 | 920 | 865 | 690 | — | — | 15 | 55 | — | — | — | 400 | Air cooling |
| The invention | 54 | J | 89 | 910 | 860 | 700 | — | — | 15 | 60 | — | — | — | 380 | Air cooling |
| The invention | 55 | B | 88 | 930 | 855 | 700 | — | — | 15 | 60 | — | — | — | 400 | Air cooling |
| Comp. Ex. | 56 | C | 90 | 930 | 855 | 700 | — | — | 15 | 60 | — | — | — | 400 | Air cooling |
| The invention | 57 | K | 87 | 910 | 810 | 745 | — | — | 30 | 65 | — | — | — | 400 | Air cooling |
| The invention | 58 | K | 86 | 905 | 820 | — | 745 | 650 | — | — | 50 | 30 | 45 | 385 | Air cooling |
| The invention | 59 | K | 90 | 915 | 855 | 755 | — | — | 35 | 75 | — | — | — | 375 | Air cooling |
| The invention | 60 | K | 91 | 910 | 860 | — | 800 | 700 | — | — | 60 | 20 | 50 | 375 | Air cooling |
| The invention | 61 | L | 92 | 910 | 805 | 740 | — | — | 30 | 60 | — | — | — | 395 | Air cooling |
| The invention | 62 | L | 84 | 920 | 815 | — | 750 | 655 | — | — | 55 | 30 | 45 | 390 | Air cooling |
| The invention | 63 | L | 87 | 905 | 855 | 760 | — | — | 35 | 75 | — | — | — | 380 | Air cooling |
| The invention | 64 | L | 85 | 910 | 855 | — | 800 | 695 | — | — | 60 | 25 | 50 | 385 | Air cooling |

| Item | No. | TS (kgf/mm$^2$) | T.El (%) | U.El (%) | $\gamma$R (%) | $V_{PF}/d_{PF}$ | TS × T.El |
|---|---|---|---|---|---|---|---|
| The invention | 38 | 86 | 31 | 20 | 9 | 7.3 | 2666 |
| The invention | 39 | 81 | 35 | 23 | 11 | 7.6 | 2835 |
| The invention | 40 | 82 | 37 | 25 | 13 | 8.6 | 3034 |
| Comp. Ex. | 41 | 86 | 24 | 12 | 3 | 5.2 | 2064 |
| The invention | 42 | 76 | 32 | 20 | 6 | 7.1 | 2432 |
| Comp. Ex. | 43 | 75 | 29 | 16 | 4 | 7.8 | 2175 |
| Comp. Ex. | 44 | 73 | 27 | 14 | 0 | 7.7 | 1971 |
| The invention | 45 | 77 | 33 | 20 | 7 | 7.3 | 2541 |
| The invention | 46 | 77 | 32 | 20 | 7 | 7.2 | 2464 |
| The invention | 47 | 100 | 28 | 20 | 10 | 7.8 | 2800 |
| Comp. Ex. | 48 | 101 | 22 | 12 | 4 | 8.0 | 2222 |
| The invention | 49 | 80 | 31 | 20 | 6 | 7.3 | 2480 |
| Comp. Ex. | 50 | 78 | 27 | 14 | 3 | 7.2 | 2106 |
| The invention | 51 | 77 | 32 | 20 | 8 | 7.4 | 2464 |
| The invention | 52 | 70 | 35 | 22 | 6 | 7.6 | 2450 |
| Comp. Ex. | 53 | 69 | 31 | 16 | 4 | 7.7 | 2139 |
| The invention | 54 | 84 | 30 | 20 | 7 | 8.0 | 2520 |
| The invention | 55 | 67 | 37 | 22 | 6 | 7.9 | 2479 |
| Comp. Ex. | 56 | 64 | 33 | 18 | 3 | 7.6 | 2112 |
| The invention | 57 | 82 | 36 | 24 | 12 | 7.7 | 2952 |
| The invention | 58 | 84 | 36 | 24 | 14 | 7.2 | 3024 |
| The invention | 59 | 83 | 33 | 21 | 6 | 7.2 | 2739 |
| The invention | 60 | 85 | 34 | 22 | 11 | 7.7 | 2890 |
| The invention | 61 | 81- | 37 | 25 | 11 | 7.8 | 2997 |
| The invention | 62 | 85 | 35 | 23 | 13 | 7.1 | 2975 |
| The invention | 63 | 83 | 32 | 20 | 7 | 7.2 | 2656 |
| The invention | 64 | 85 | 34 | 22 | 12 | 7.8 | 2890 |

TABLE 3

| Item | No. | Steel species | Total draft at finishing (%) | $FT_0$ (°C.) | $FT_7$ (°C.) | T (°C.) | $T_1$ (°C.) | $T_2$ (°C.) | Cooling rate (°C./s) ① | ② | ①' | ②' | ③' |
|---|---|---|---|---|---|---|---|---|---|---|---|---|---|
| The invention | 65 | A | 83 | 910 | 790 | 790 | — | — | Isothermal holding | 55 | — | — | — |

TABLE 3-continued

| | | | | | | | | | | | | | |
|---|---|---|---|---|---|---|---|---|---|---|---|---|---|
| The invention | 66 | A | 85 | 910 | 790 | 790 | — | — | Isothermal holding | 60 | — | — | — |
| The invention | 67 | A | 84 | 905 | 790 | 790 | — | — | Isothermal holding | 62 | — | — | — |
| The invention | 68 | A | 90 | 925 | 830 | — | 750 | 750 | — | — | 70 | Isothermal holding | 70 |
| The invention | 69 | A | 95 | 940 | 865 | 790 | — | — | 35 | 70 | — | — | — |
| The invention | 70 | A | 93 | 950 | 870 | — | 770 | 770 | — | — | 80 | Isothermal holding | 65 |

| Item | No. | Holding time (sec.) | CT (°C.) | Cooling after coiling | TS (kgf/mm$^2$) | T.El (%) | U.El (%) | $\gamma$R (%) | $V_{PF}/d_{PF}$ | TS × T.El |
|---|---|---|---|---|---|---|---|---|---|---|
| The invention | 65 | 2 | 380 | Air cooling | 80 | 36 | 24 | 12 | 7.6 | 2880 |
| The invention | 66 | 3 | 385 | Air cooling | 80 | 38 | 26 | 13 | 7.7 | 3040 |
| The invention | 67 | 25 | 380 | Air cooling | 81 | 40 | 28 | 15 | 7.8 | 3240 |
| The invention | 68 | 5 | 400 | Air cooling | 81 | 39 | 27 | 14 | 8.0 | 3159 |
| The invention | 69 | 7 | 420 | Air cooling | 85 | 33 | 21 | 12 | 7.5 | 2805 |
| The invention | 70 | 5 | 430 | Air cooling | 82 | 36 | 24 | 13 | 7.7 | 2952 |

TABLE 4

| Item | No. | Steel species | Total draft at finishing (%) | $FT_0$ (°C.) | $FT_7$ (°C.) | T (°C.) | $T_1$ (°C.) | $T_2$ (°C.) | Cooling rate (°C./s) 1 | 2 | ①' | ②' | ③' | CT (°C.) | Cooling after coiling |
|---|---|---|---|---|---|---|---|---|---|---|---|---|---|---|---|
| The invention | 71 | M | 83 | 890 | 805 | — | 750 | 655 | — | — | 50 | 20 | 50 | 385 | Air cooling |
| The invention | 72 | N | 81 | 890 | 830 | — | 770 | 660 | — | — | 60 | 30 | 60 | 365 | Air cooling |
| The invention | 73 | O | 82 | 880 | 825 | — | 700 | 655 | — | — | 85 | 25 | 85 | 465 | Air cooling |
| The invention | 74 | P | 86 | 885 | 810 | — | 750 | 695 | — | — | 70 | 25 | 70 | 375 | 40° C./hr |
| The invention | 75 | Q | 84 | 895 | 810 | — | 735 | 665 | — | — | 80 | 30 | 80 | 380 | 40° C./hr |
| The invention | 76 | R | 86 | 870 | 785 | — | 720 | 665 | — | — | 80 | 30 | 80 | 395 | Air cooling |
| The invention | 77 | S | 88 | 910 | 860 | 705 | — | — | 15 | 65 | — | — | — | 385 | Air cooling |
| The invention | 78 | T | 88 | 890 | 805 | 745 | — | — | 30 | 60 | — | — | — | 410 | 40° C./hr |
| The invention | 79 | U | 93 | 890 | 805 | 740 | — | — | 30 | 70 | — | — | — | 390 | Air cooling |
| The invention | 80 | U | 85 | 920 | 815 | — | 750 | 655 | — | — | 55 | 30 | 50 | 390 | 40° C./hr |

| Item | No. | TS (kgf/mm$^2$) | T.El (%) | U.El (%) | $\gamma$R (%) | $V_{PF}/d_{PF}$ | TS × T.El |
|---|---|---|---|---|---|---|---|
| The invention | 71 | 80 | 37 | 26 | 14 | 8.8 | 2960 |
| The invention | 72 | 67 | 40 | 26 | 13 | 7.4 | 2680 |
| The invention | 73 | 102 | 30 | 21 | 13 | 8.0 | 3060 |
| The invention | 74 | 80 | 38 | 26 | 13 | 8.3 | 3040 |
| The invention | 75 | 76 | 40 | 28 | 14 | 7.5 | 3040 |
| The invention | 76 | 71 | 41 | 27 | 14 | 7.7 | 2911 |
| The invention | 77 | 84 | 31 | 21 | 8 | 8.0 | 2604 |
| The invention | 78 | 83 | 35 | 23 | 11 | 7.7 | 2905 |
| The invention | 79 | 82 | 36 | 24 | 10 | 7.8 | 2952 |
| The invention | 80 | 85 | 35 | 25 | 13 | 7.3 | 2975 |

As has been described above, a hot rolled steel sheet with a high strength and a particularly distinguished ductility (TS×T.El>2,416) can be produced with a high productivity and without requiring special alloy elements according to the present invention, and thus the present invention has a very important industrial significance.

What is claimed is:

1. A process for producing a hot rolled steel sheet with a high strength and a distinguished formability, which comprises subjecting a steel consisting essentially of 0.15 to 0.4% by weight of C, 0.5 to 2.0% by weight of Si, and 0.5 to 2.0% by weight of Mn, the balance being iron and inevitable impurities to a hot finish rolling with a total draft of at least 80% in such a manner that its rolling end temperature is within a range between $Ar_3$+50° C. and $Ar_3$−50° C., successively cooling the steel down to a desired temperature T within a temperature range from the lower one of the $Ar_3$ of said steel or said rolling end temperature to $Ar_1$ at a cooling rate of less than 40° C./sec., successively cooling the steel at a cooling rate of 40° C./sec. or more, and coiling the steel at a temperature of from over 350° C. to 500° C.

2. A process according to claim 1, wherein it is conducted for 3 to 25 seconds to cool said steel within a temperature range from the lower one of the $Ar_3$ or said rolling end temperature to said desired temperature T or to hold said steel isothermally within said temperature range.

3. A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal with S being limited to not more than 0.010% by weight and the balance being iron and inevitable impurities to a hot finish rolling with a total draft of at least 80% in such a manner that its rolling end temperature is within a range between $Ar_3$+50° C. and $Ar_3$−50° C., successively cooling the steel down to a desired temperature T within a range from the lower one of the $Ar_3$ of said steel or said rolling end temperature to $Ar_1$ at a cooling rate of less than 40° C./sec., successively cooling the steel at a cooling rate of 40° C./sec. or more, and coiling the steel at a temperature of from over 350° C. to 500° C.

4. A process according to claim 3, wherein it is conducted for 3 to 25 seconds to cool said steel within a temperature range from the lower one of the $Ar_3$ of said steel or said rolling end temperature to said desired temperature T or to hold said steel isothermally within said temperature range.

5. A process for producing a hot rolled steel sheet with a high strength and a distinguished formability, which comprises subjecting a steel consisting essentially of 0.15 to 0.4% by weight of C, 0.5 to 2.0% by weight of Si and 0.5 to 2.0% by weight of Mn, the balance being iron and inevitable impurities to a hot finish rolling with a total draft of at least 80% in such a manner that its rolling end temperature is within a range between $Ar_3+50°$ C. and $Ar_3-50°$ C., setting two desired temperatures $T_1$ and $T_2$, wherein $T_1 \geqq T_2$ within a temperature range from the lower one of the $Ar_3$ of said steel or said rolling end temperature to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

6. A process according to claim 5, wherein it is conducted for 3 to 25 seconds to cool said steel within a temperature range from said desired temperature $T_1$ to said desired temperature $T_2$ or to hold said steel isothermally within said temperature range.

7. A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal with S being limited to not more than 0.010% by weight and the balance being iron and inevitable impurities to a hot finish rolling with a total draft of at least 80% in such a manner that its rolling end temperature is within a range between $Ar_3+50°$ C. and $Ar_3-50°$ C., setting two desired temperatures $T_1$ and $T_2$, wherein $T_1 \geqq T_2$ within a temperature range from the lower one of the $Ar_3$ of said steel or said rolling end temperature to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

8. A process according to claim 7, wherein it is conducted for 3 to 25 seconds to cool said steel within a temperature range from said desired temperature $T_1$ to said desired temperature $T_2$ or to hold said steel isothermally within said temperature range.

9. A process for producing a hot rolled steel sheet with a high strength and a distinguished formability, which comprises subjecting a steel consisting essentially of 0.15 to 0.4% by weight of C, 0.5 to 2.0% by weight of Si, and 0.5 to 2.0% by weight of Mn, the balance being iron and inevitable impurities to a hot finish rolling with a total draft of at least 80% in such a manner that its rolling end temperature exceeds $Ar_3+50°$ C., successively cooling the steel down to a desired temperature T within a temperature range from the $Ar_3$ of the steel to $Ar_1$ at a cooling rate of less than 40° C./sec., successively cooling the steel at a cooling rate of 40° C./sec. or more, and coiling the steel at a temperature of from over 350° C. to 500° C.

10. A process according to claim 9, wherein it is conducted for 3 to 25 seconds to cool said steel within a temperature range from the $Ar_3$ of said steel to said desired temperature T or to hold said steel isothermally within said temperature range.

11. A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal with S being limited to not more than 0.010% by weight and the balance being iron and inevitable impurities to a hot finish rolling with a total draft of at least 80% in such a manner that its rolling end temperature exceeds $Ar_3+50°$ C., successively cooling the steel down to a desired temperature T within a range from the $Ar_3$ of the steel to $Ar_1$ at a cooling rate of less than 40° C./sec., successively cooling the steel at a cooling rate of 40° C./sec. or more, and coiling the steel at a temperature of from over 350° C. to 500° C.

12. A process according to claim 11, wherein it is conducted for 3 to 25 seconds to cool said steel within a temperature range from the $Ar_3$ of said steel to said desired temperature T or to hold said steel isothermally within said temperature range.

13. A process for producing a hot rolled steel sheet with a high strength and a distinguished formability, which comprises subjecting a steel consisting essentially of 0.15 to 0.4% by weight of C, 0.5 to 2.0% by weight of Si and 0.5 to 2.0% by weight of Mn, the balance being iron and inevitable impurities to a hot finish rolling with a total draft of at least 80% in such a manner that its rolling end temperature exceeds $Ar_3+50°$ C., setting two desired temperatures $T_1$ and $T_2$, wherein $T_1 \geqq T_2$ within a temperature range from the $Ar_3$ of the steel to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

14. A process according to claim 13, wherein it is conducted for 3 to 25 seconds to cool said steel within a temperature range from said desired temperature $T_1$ to said desired temperature $T_2$ or to hold said steel isothermally within said temperature range.

15. A process for producing a hot rolled steel sheet with a high strength and a distinguished formability, which comprises subjecting a steel consisting essentially of 0.15 to 0.4% by weight of C, 0.5 to 2.0% by weight of Si, 0.5 to 2.0% by weight of Mn and one of 0.0005 to 0.0100% by weight of Ca and 0.005 to 0.050% by weight of rare earth metal with S being limited to not more than 0.010% by weight and the balance being iron and inevitable impurities to a hot finish rolling with a total draft of at least 80% in such a manner that its rolling end temperature exceeds $Ar_3+50°$ C., setting two desired temperatures $T_1$ and $T_2$, wherein $T_1 \geqq T_2$ within a temperature range from the $Ar_3$ of the steel to $Ar_1$, successively cooling the steel down to the $T_1$ at a cooling rate of 40° C./sec. or more, successively cooling the steel down to the $T_2$ at a cooling rate of less than 40° C./sec., further cooling the steel at a cooling rate of 40° C./sec. or more, and coiling the steel at a temperature of from over 350° C. to 500° C.

16. A process according to claim 15, wherein it is conducted for 3 to 25 seconds to cool said steel within a temperature range from said desired temperature $T_1$ to said desired temperature $T_2$ or to hold said steel isothermally within said temperature range.

17. A process according to any one of claims 1 to 16, wherein a hot finish rolling starting temperature of the steel is set to not more than ($Ar_3+100°$ C.).

18. A process according to any one of claims 1 to 16, wherein the steel sheet after the coiling is cooled down to not more than 200° C. at a cooling rate of 30° C./hr. or more.

19. A process according to any one of claims 1 to 16, wherein said steel further contains 0.004 to 0.040% by weight of Al.

20. A process according to any one of claims 1 to 16, wherein said steel further contains 0.004 to 0.040% by weight of Al and a hot finish rolling starting temperature of the steel is set to not more than ($Ar_3+100°$ C.).

21. A process according to any one of claims 1 to 16, wherein said steel further contains 0.004 to 0.040% by weight of Al and the steel sheet after the coiling is cooled down to not more than 200° C. at a cooling rate of 30° C./hr. or more.

* * * * *